United States Patent [19]

Hilbert et al.

[11] 4,159,396

[45] Jun. 26, 1979

[54] AM STEREO RECEIVER HAVING SIGNAL-CONTROLLED CORRECTOR

[75] Inventors: Francis H. Hilbert, Addison; Norman W. Parker, Wheaton, both of Ill.

[73] Assignee: Motorola, Inc., Schaumburg, Ill.

[21] Appl. No.: 837,257

[22] Filed: Sep. 27, 1977

[51] Int. Cl.[2] ..... H04H 5/00

[52] U.S. Cl. ..... 179/1 GS

[58] Field of Search ..... 179/15 BT, 1 GS; 325/36, 60, 456

[56] References Cited

U.S. PATENT DOCUMENTS

| | | | |
|---|---|---|---|
| 3,068,475 | 12/1962 | Avins | 179/15 BT |
| 3,080,453 | 3/1963 | Avins | 179/15 BT |
| 3,534,172 | 10/1970 | Weeda | 179/15 BT |
| 3,823,268 | 7/1974 | Modafferi | 179/15 BT |
| 4,018,994 | 4/1977 | Kahn | 179/15 BT |
| 4,037,057 | 7/1977 | Ogita et al. | 179/15 BT |

*Primary Examiner*—Douglas W. Olms

*Attorney, Agent, or Firm*—Margaret Marsh Parker; James W. Gillman

[57] ABSTRACT

A signal level controlled switching circuit removes the stereo correction factor in a compatible AM stereo receiver when the received signal level is low enough to allow signal degradation due to noise affecting the correction factor. The switching circuit can operate on either an instantaneous or an average signal level.

5 Claims, 3 Drawing Figures

AM STEREO RECEIVER HAVING SIGNAL-CONTROLLED CORRECTOR

BACKGROUND OF THE INVENTION

The present invention relates to the field of compatible AM stereo receivers and more particularly to a means for improving performance by removing the correction factor during periods of low signal level.

In a stereo receiver for receiving a compatible AM stereo broadcast signal, a stereo corrector is used to restore the original left and right signals. Such a compatible signal is described in a co-pending application, Ser. No. 674,703, assigned to the same assignee as is the present invention.

In the transmitter of the above-referenced application, a carrier signal is modulated in quadrature by sum and difference signals. The combined quadrature signal is then amplitude limited to provide a signal having only phase information thereon. In a high level modulator stage, the limited carrier is again amplitude modulated, but with the sum signal only. Thus there is provided an output signal having only monophonic information on the envelope but having the correct phase information for stereo reception. In any stereo receiver for use with this signal, a correction factor must be utilized to restore exactly the original sum and difference signals. Since the broadcast signal differs from the original stereo signal (before limiting in the transmitter) by a factor equal to the cosine of the angle between a vector representing the sum signal and a vector representing the instantaneous quadrature signal, proper correction in a stereo receiver must include a division by this cosine correction factor.

With any reasonable signal, the cosine division will provide accurate stereo with no side effects. However, if a significantly weak or noisy signal is received, there will not only be noise in the demodulated (L-R)cos $\phi$ channel, but also a noise effect in the correction factor. Thus the process of correction could multiply the effect of the noise, further degrading the received signal. It is therefore desirable, though not necessary, to prevent division by the correction factor in a stereo receiver during periods of weak received signal.

SUMMARY OF THE INVENTION

It is therefore an object of the present invention to improve the signal-to-noise ratio during periods of poor reception in a compatible AM stereo receiver.

It is a particular object to provide this improvement by removing the cosine correction factor only during such periods.

In a compatible AM stereo receiver having a signal-controlled corrector in accordance with the present invention, a signal proportional to the received signal level, as for example the output of an L+R envelope detector circuit, can be used to control a switching circuit which will in effect prevent the cosine correction factor from being applied for the purpose of restoring the exact original sum and difference stereo signals. In the various embodiments of stereo receivers described in the above-referenced co-pending application or in any stereo receiver utilizing the cosine correction factor for restoring stereophonic signals, the circuit of the present invention could be applied wherever division by the correction factor is utilized. This could be once or twice in a given receiver, depending upon the point or points in the circuit where the correction factor is applied.

As shown and described hereinbelow, the signal-controlled corrector circuit will be applied, in an exemplary fashion only, to a compatible AM stereo receiver which is more fully described in another co-pending application Ser. No. 837,258 assigned to the same assignee as is the present application, and filed as of even date with the present application.

DETAILED DESCRIPTION OF THE PREFERRED EMBODIMENTS

Figure 1:
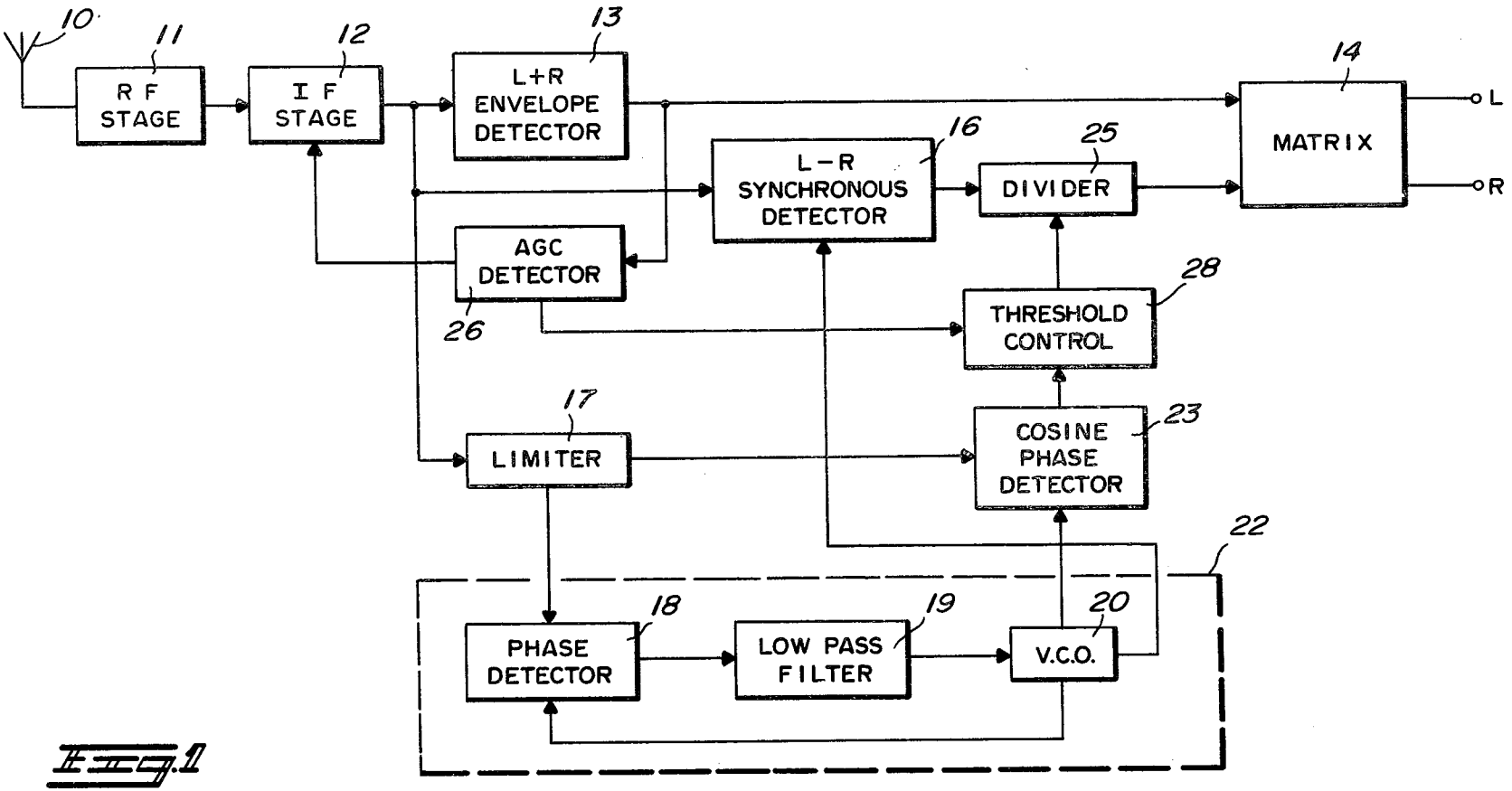
FIG. 1 is a block diagram of a receiver including the present invention.
Figure 2:
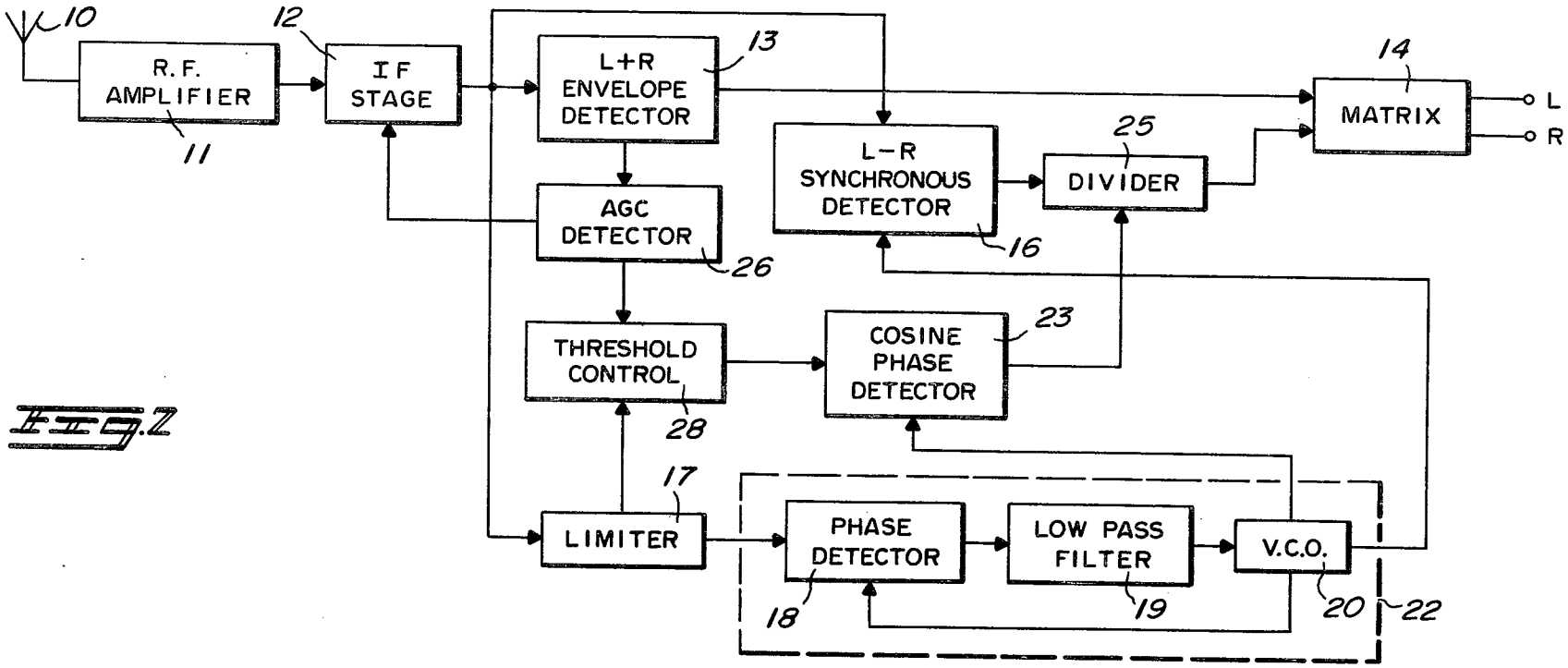
FIG. 2 is a block diagram of a second embodiment of the receiver of FIG. 1.

The receiver shown in FIGS. 1 and 2 is designed to receive a compatible AM stereo signal from a transmitter as shown and described in the co-pending application, Ser. No. 674,703. The broadcast signal of such a transmitter is compatible with present monophonic receivers in that the carrier is amplitude modulated with a monophonic signal only (1+L+R), with all stereo information being carried by phase modulation. In brief, the carrier is modulated in quadrature with the sum (L+R) and difference (L−R) signals, limited to remove amplitude variation and leaving only phase variation, then amplitude modulated with 1+L+R in the high level modulator. The output or broadcast signal is then of the form $(1+L+R)\cos\{\omega_c t+\phi\}$ where $\phi$ is arc $\tan\{(L-R)/(1+L+R)\}$. It is to be noted that "L" and "R" are used herein in an exemplary fashion only.

Operationally, an antenna 10 receives a compatible AM stereo signal of the form given hereinabove, and this signal is processed in the usual fashion in RF stage 11 and IF stage 12. The monophonic or sum signal L+R is obtained by coupling the output of the IF stage to an envelope detector 13. The L+R signal is then coupled to a matrix 14. The output of the IF stage 12 is also coupled to a synchronous detector 16 and to a limiter 17. An output of the limiter 17 is coupled to a phase detector 18, which with a lowpass filter 19 and voltage controlled oscillator 20, comprises a phase locked loop (PLL) 22. The output of the PLL 22 is a function of the phase of the unmodulated carrier (in $\omega_c t$) and is coupled to the synchronous detector 16. The synchronous detector 16 is likewise a multiplier as is known, and multiplies the output signal from the IF stage 12, $(1+L+R)\cos(\omega_c t+\phi)$, by the sin $\omega_c t$ output of the VCO 20. This product would then be $(1+L+R)[\sin(2\omega_c t+\phi)+\sin\phi]$. Disregarding the double frequency term, this becomes $(1+L+R)\sin\phi$ where $\phi$ is arc $\tan[(L-R)/(1+L+R)]$. The sine of the angle whose tangent is $(L-R)/(1+L+R)$ is $(L-R)/\sqrt{(L-R)^2+(1+L+R)^2}$ and the cosine of this angle is $(1+L+R)/\sqrt{(L-R)^2+(1+L+R)^2}$. Substituting the sine of the angle in the signal as given above one obtains $(1+L+R)(L-R)/\sqrt{(L-R)^2+(1+L+R)^2}$ which equals $(L-R)\cos\phi$. An output of the limiter 17, bearing only the transmitted phase information, is coupled to a cosine phase detector 23, as is a phase-shifted ($\cos\omega_c t$) output of the phase locked loop 22. The cosine phase detector 23 is a multiplier. The instantaneous phase difference between the two carrier frequencies (before modulation and as transmitted) is detected in the cosine phase detector 23 and provides the correction information necessary to restore the original stereo signals. The correction information is therefore proportional to the cosine of arc $\tan(L-R)/(1+L+R)$ or $(1+L+R)/\sqrt{(1+L+R)^2+(L-R)^2}$. When the correction information is coupled to a divider 25 which also receives the output of the synchronous detector 16, the output of the divider becomes L−R, the desired stereo difference signal. The L−R signal is coupled to the matrix 14 which provides L and R at its output terminals. An AGC detector 26 may be coupled from the output of the envelope detector 13 back to the IF stage 12 for controlling the gain in the IF stage, as is known in the art. The output of the AGC detector 26 is then proportional to the amplitude of the received signal level. The AGC 26 output is then utilized in a threshold control 28 to enable or disenable coupling of the correction factor from the cosine phase detector 23 to the divider 25 when the received signal level is low enough to warrant such removal. The threshold control 28 will be described further in relation to FIG. 3.

In FIG. 2 the same basic receiver is illustrated, the major difference lying in the location of the threshold control 28 within the receiver circuit. As before, the received signal is processed through the RF and IF stages and the L+R signal is detected in the envelope detector 13. The output of the IF stage 12 is processed in the synchronous detector 16, the output of which requires division by the cosine correction factor in order to provide the exact difference signal L−R to the matrix. The PLL 22 operates in the usual fashion and the cosine phase detector functions as described hereinabove with respect to FIG. 1. Again, the threshold control 28 receives from the AGC detector 26 a signal proportional to the level of the received signal, but in this embodiment the threshold control disconnects the limiter 17 from the cosine phase detector 23, thus effectively preventing the cosine correction factor from being applied to the divider 25.

The location of the threshold control in the receiver circuit may vary in different compatible AM stereo receivers, the required function be that the correction factor is not applied to the divider during periods of low signal level.

Figure 3:
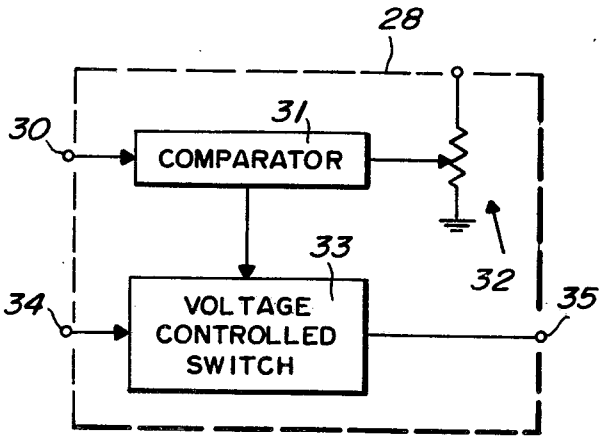
FIG. 3 is a block diagram of the signal-controlled switching circuit of the invention.

FIG. 3 is a block diagram of a preferred embodiment of the threshold control circuit 28, wherein a terminal 30 couples an output of the AGC detector 26 to one input of a comparator 31, the second input of which is a reference voltage. The reference voltage source 32 may be a variable voltage provided by a potentiometer coupled between a DC supply and ground. The comparator 31 will output only when the voltage on the terminal 30 is lower than the reference voltage from the source 32. The comparator may operate on either the average or instantaneous value of the signal on terminal 30. The comparator output is coupled to actuate a voltage-controlled switch 33 coupled between terminals 34 and 35. The switch 33 may be any of a number of voltage-controlled switches wherein an applied control signal operates to open or close a circuit therethrough. In the threshold control circuit 28, the cosine correction factor is coupled through the switch when the voltage level at terminal 30 is higher than the reference voltage. In the embodiment of FIG. 1, the terminal 34 would be coupled to the output of the cosine phase detector 23, and the terminal 35 would be an input of the divider 25. In the embodiment of FIG. 2, the terminal 34 would be coupled to an output of the limiter 17 and the terminal 35 would output to the cosine phase detector 23. In either case, no cosine correction factor would be applied to the divider 25 during periods of low signal level.

Thus, there has been shown and described an improvement for a compatible AM stereo receiver whereby the cosine correction factor, normally required for good stereo reception, is not utilized during periods of low signal level when its use could further degrade the signal. Many variations and modifications of the circuit of the invention are possible and it is intended to include all such as fall within the spirit and scope of the appended claims.

What is claimed is:

1. An AM receiver for receiving a compatible stereo signal having the form $(1+L+R)\cos(\omega_c t+\phi)$ where $\phi$ is arc tan $\{(L-R)/(1+L+R)\}$, L and R represent two program information signals and $\omega_c t$ represents a carrier frequency, the receiver comprising in combination:

input means for receiving said signal and translating said signal to an intermediate frequency signal;

detector means coupled to the input means for providing approximate sum (L+R) and difference (L−R) signals;

a corrector circuit for providing a correction signal for use in restoring exact sum and difference signals;

level detect means for providing an output signal in response to the level of the received signal; and control means coupled to the level detect means and to the corrector circuit for disenabling the function of the corrector circuit in response to a received signal level lower than a predetermined level whereby approximate L and R signals are obtained from the received signal.

2. A receiver according to claim 1 wherein the approximate sum signal is $(L+R)\cos\phi$ and the approximate difference signal is $(L-R)\cos\phi$ and the corrector circuit provides a correction signal proportional ot the cosine of arc tan $\{(L-R)/(1+L+R)\}$.

3. A receiver according to claim 1 wherein the level detect means is an AGC detector circuit.

4. A receiver according to claim 1 wherein the control means comprises a source of reference voltage, a comparator for comparing an output of the level detect means and the reference voltage and providing a control signal in response to a received signal level lower than a predetermined level, and a voltage-controlled switch coupled to disenable the function of the corrector circuit in response to the control signal.

5. A receiver according to claim 4 wherein the predetermined level of reference voltage is controllable.

* * * * *